United States Patent [19]

Eklöf et al.

[11] 4,073,350

[45] Feb. 14, 1978

[54] DEVICE FOR DAMPING THE RECOIL OF A WORK TOOL CONNECTED TO A PERCUSSION TOOL

[75] Inventors: Åke Torsten Eklöf, Skarholmen; Per Tage Allan Fengsborn, Amal; Gunnar Vigg Riss Romell, Djursholm, all of Sweden

[73] Assignee: Atlas Copco Aktiebolag, Nacka, Sweden

[21] Appl. No.: 665,056

[22] Filed: Mar. 8, 1976

[30] Foreign Application Priority Data

Mar. 18, 1975 Sweden ..... 7503097

[51] Int. Cl.[2] ..... B25D 9/00

[52] U.S. Cl. ..... 173/139; 92/85 B; 173/134

[58] Field of Search ..... 173/139, 134; 92/85 B, 92/143

[56] References Cited

U.S. PATENT DOCUMENTS

| | | | |
|---|---|---|---|
| 3,168,324 | 2/1965 | Kennell | 173/139 |
| 3,266,581 | 8/1966 | Cooley et al. | 173/139 |
| 3,451,492 | 6/1969 | Ekstrom et al. | 173/139 |
| 3,741,072 | 6/1973 | Rommell et al. | 91/290 |
| 3,831,500 | 8/1974 | Kitamura | 92/85 B |
| 3,866,690 | 2/1975 | Lance et al. | 173/15 |

*Primary Examiner*—Robert A. Hafer
*Attorney, Agent, or Firm*—Flynn & Frishauf

[57] ABSTRACT

A recoil damping device for a percussion tool in which the recoils are damped by means of a pressurized hydraulic fluid entrapped in the machine housing.

14 Claims, 3 Drawing Figures

DEVICE FOR DAMPING THE RECOIL OF A WORK TOOL CONNECTED TO A PERCUSSION TOOL

BACKGROUND OF THE INVENTION

The present invention relates to percussion tools, such as rock drilling machines, chiselling machines or the like, and concerns a device for damping the recoil of a work tool connected to the percussion tool. A hammer piston is reciprocable in a machine housing and is adapted to deliver impact energy to the work tool and the recoil damping device is adapted to transfer a feeding force from the machine housing to the work tool.

SUMMARY OF THE INVENTION

The present invention aims to achieve a recoil damping device in percussion tools which is insusceptible to the number of load variations.

Another object of the invention is to provide a hydraulic recoil damping device for percussion tools, wherein a retarded piston is urged forwards by a force which exceeds the feeding force applied to the percussion tool.

A further object of the invention is to provide a thrust bearing for the work tool in rock drilling machines.

A still further object is to achieve a hydraulic recoil damping device in hydraulic fluid actuated percussion tools which does not increase the number of accumulators normally present in such tools.

The above and other objects of the invention will become apparent from the following description with reference to the accompanying drawings, in which one embodiment of the invention is shown by way of example. It is to be understood that this embodiment is only illustrative of the invention and that various modifications thereof may be possible within the scope of the claims following hereinafter.

DETAILED DESCRIPTION OF ILLUSTRATED EMBODIMENT

Figure 1:
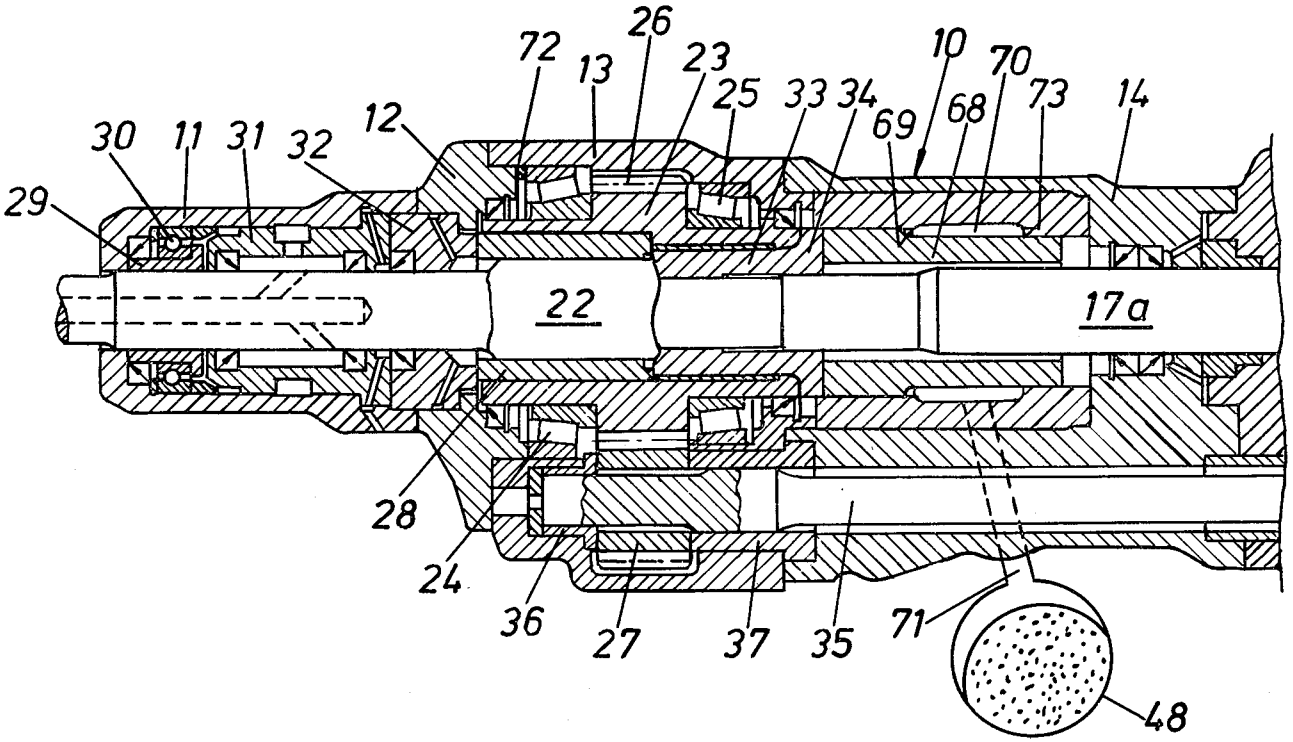
FIG. 1 is a longitudinal section through the front part of a rock drill according to the invention.
Figure 2:
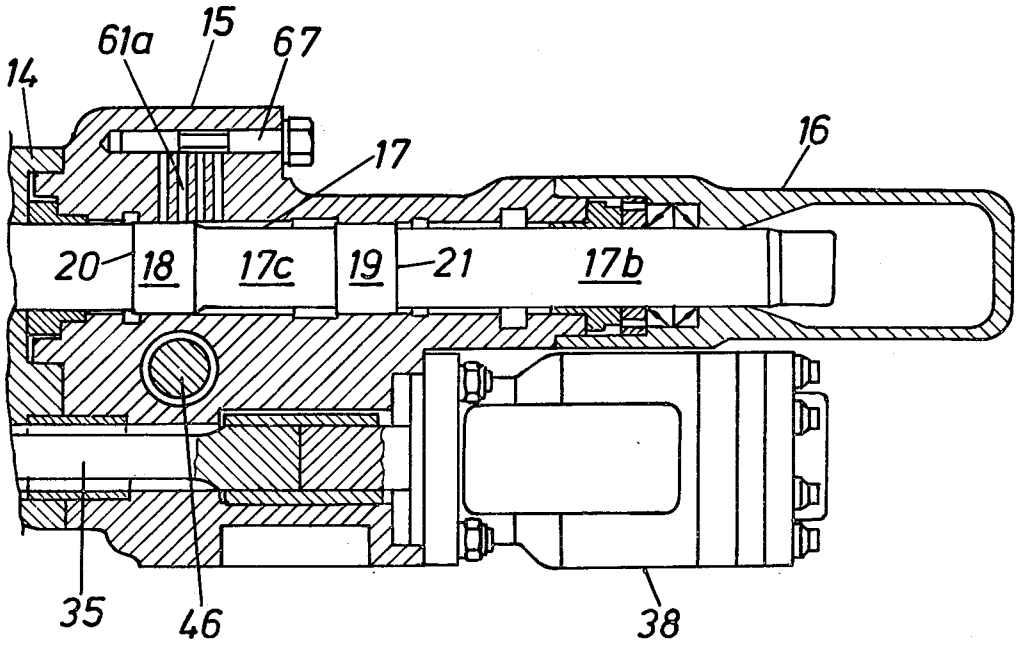
FIG. 2 is a longitudinal section through the rear part of the rock drill.

In the figures, the rock drilling machine 10 comprises a front head 11, a cover 12, a gear housing 13, an intermediate part 14, a cylinder 15 and a back head 16. A hammer piston 17 is reciprocating within the cylinder 15. The hammer piston 17 consists of a cylindrical rod with two piston portions 18, 19 having piston surfaces 20, 21. The portion of the hammer piston which extends forwardly from the piston portion 18 is denoted by **17*a*, and the portion which extends rearwardly from the piston portion 19 is denoted by 17*b*. The rod portion between the rod portions 18, 19 is denoted by 17*c***.

The piston portion **17*a* is arranged to deliver impacts against an adapter 22, which is intended to be connected with a not shown drill string. A rotation chuck 23 is rotatably journalled in the gear housing 13 by means of roller bearings 24, 25. The rotation chuck 23 is provided with a gear ring 26 which cooperates with a gear wheel 27. A driver 28 transmits the rotation of the rotation chuck 23 to the adapter 22. The adapter 22 is thus non-turnably guided in the driver 28; axially movable, however, relative to the driver. The forward end of the adapter 22 is journalled in the front head 11 by means of a guide 29 and a ball bearing 30. Flushing fluid is supplied to the axial hole of the adapter 22 and the drill string through a flushing head 31. A stop ring 32 is mounted between the flushing head 31 and the driver 28. A rotation chuck bushing 33 is inserted in the rear portion of the rotation chuck 23. The rotation chuck bushing 33 is provided with a collar 34 adapted to rest against a rear end surface of the rotation chuck 23**.

The gear wheel 27 is splined to a shaft 35. The shaft 35 is journalled in bushings 36, 37 in the gear housing 13. The shaft 35 is rotated by means of a hydraulic motor 38 attached to the cylinder 15.

Figure 3:
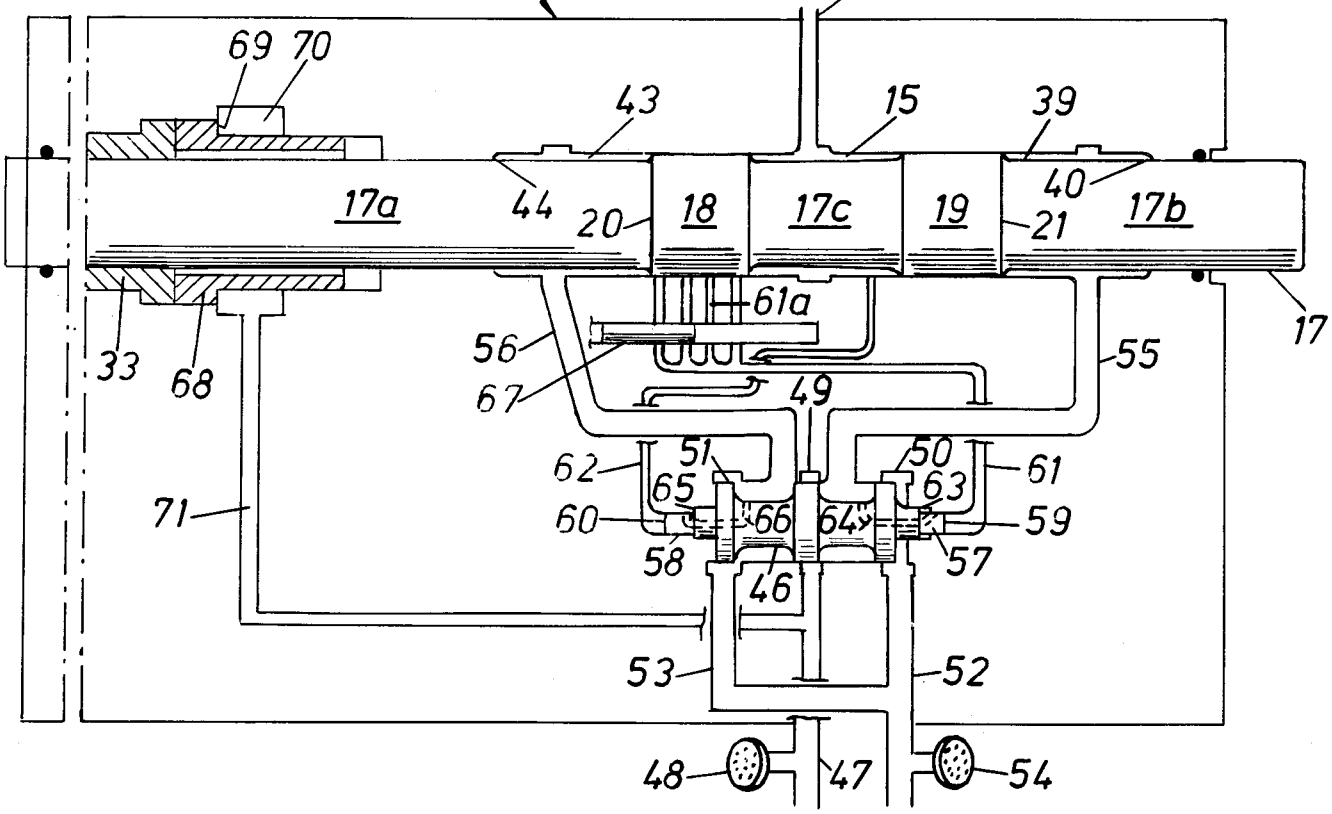
FIG. 3 shows a coupling circuitry of the rock drill shown in FIGS. 1 and 2. Corresponding details have been given the same reference numeral in the various figures.

As seen in FIG. 3, a rear annular pressure chamber 39 is defined by the cylinder 15, the rod portion **17*b*, the piston surface 21 on the piston portion 19, and the front surface of a sealing ridge 40. A forward annular pressure chamber 43 is defined in the same way by the cylinder 15, the rod portion 17*a*, the piston surface 20 on the piston portion 18, and the rear surface of a circular sealing ridge 44**.

A distributing valve in the form of a slide 46 is supplied with pressurized hydraulic fluid through a supply conduit 47. An accumulator 48 is continuously connected to the supply conduit 47. On the one hand, the accumulator 48 discharges an instantaneously increasing pressurized hydraulic fluid flow during the working stroke of the hammer piston 17, and on the other it receives a certain amount of hydraulic fluid before the hammer piston has reversed upon the slide shift at the extreme positions. The supply conduit 47 leads to an annular inlet chamber 49 in the cylinder of the distributing valve. The cylinder of the valve has also two annular outlet chambers 50, 51 to which return conduits 52, 53 are connected. These return conduits lead to a non-illustrated sump from which a non-illustrated positive displacement pump sucks hydraulic fluid so as to supply the supply conduit 47 with a constant flow of pressurized hydraulic fluid through a non-illustrated control valve. An accumulator 54 is continuously connected to the return conduits 52, 53. The accumulator 54 shall prevent pressure shocks from arising in the system. The accumulators 48, 54 equalize the highly fluctuating need of pressurized hydraulic fluid of the impactor during the cycle of impacts and also equalize the pressure peaks.

With the slide 46 in its left-hand end position, FIG. 3, pressurized hydraulic fluid is supplied to the rear pressure chamber 39 through a combined supply and drain passage 55 while the forward pressure chamber 43 is drained through the return conduit 53 through another combined supply and drain passage 56. With the slide 46 in its non-illustrated right-hand end position, pressurized hydraulic fluid is instead supplied to the forward pressure chamber 43 through the passage 56 while the rear pressure chamber 39 is drained through the passage 55.

The slide 46 has extending end portions 57, 58, the end surfaces 59, 60 of which are acted upon by the pressure in control passages 61, 62 which terminate in the cylinder wall of the hammer piston 17. The end portion 58 has an annular piston surface 63 which is acted upon by the pressure in the passage 55 through a passage 64 in the slide 46. The end portion 59 has a similar piston surface 65 which is acted upon by the pressure in the passage 56 through a passage 66 in the slide 46. The piston surfaces 63, 65 constitute holding surfaces and are therefor of smaller area than the end surfaces 59, 60 which constitute shifting surfaces. A passage 74 is connected to tank so as to drain the space between the piston portions 18, 19. Thereby, one of the control passages 61, 62 will always drain through this passage 74 when the other one of these control passages is supplied with pressurized hydraulic fluid.

The control passage 61 has four branches which terminate in the cylinder wall of the hammer piston 17. The reference numeral 61*a* denotes one of these branches. One or several of these branches can be blocked by means of an exchangeable regulator plug 67. By this arrangement the rear turning point of the hammer piston 17 and thereby the piston stroke can be varied, which means that various number of strokes and percussion energy per blow can be obtained.

A retard piston 68 is displaceably and rotatably guided in the intermediate part 14. A rear piston surface 69 on the retard piston defines a movable limitation wall of a retard or cushioning chamber 70. The retard chamber 70 is limited rearwards by a surface 73 in the machine housing. The retard chamber 70 communicates with the supply conduit 47 and the accumulator 48 through a passage 71. The feeding force applied to the rock drill 10 is transferred to the drill string via the pressurized hydraulic fluid cushion entrapped in the retard chamber 70. Preferably, the piston surface 69 on the retard piston 68 and the accumulator 48 are dimensioned so that the force acting forwardly on the retard piston 68 substantially exceeds the feeding force. By such a dimensioning is achieved that the position in which the adapter 22 and thus the work tool is situated when the hammer piston hits the adapter remains unchanged independently of variations in the feeding force. Also when the invention is applied in chiselling-type machines, i.e. machines without rotation of the work tool, such "prestressing" of the entrapped fluid cushion acting as a hydraulic spring is often advantageous. This forwardly-acting force is transferred to a surface 72 on the cover 12 via the collar 34 of the rotation chuck bushing 33, the rotation chuck 23 and the thrust bearing 24.

The operation of the rock drill will now be described with reference to the figures.

Assume that the slide 46 is in the position shown in FIG. 3, so that the rear pressure chamber 39 is supplied with pressurized hydraulic fluid and the forward pressure chamber 43 is evacuated. Assume also that the hammer piston 17 is moving forwards. The regulator plug 67 blocks the two right branches of the control passage 61. In the position in which the hammer piston 17 is in FIG. 3, the control passage 62 is being drained through the draining passage 74 and the control passage 61 has been drained through the forward pressure chamber 43 until the piston portion 18 covered the branch 61*a*. The slide 46 is positively retained in its position because the pressure in the supply conduit 55 is transmitted to the holding surface 63 of the slide. When the hammer piston 17 moves on forwards (to the left in FIG. 3) the control passage 61 is again opened so as to drain now into the draining passage 74. Then, when the piston portion 19 passes the opening of the control passage 62, it uncovers this opening into the rear pressure chamber 39 from which the pressure is conveyed through the control passage 62 to the end face 60 of the slide. Now, the slide shifts to its non-illustrated second position (to the right in FIG. 3) so that the forward pressure chamber 43 is pressurized while the rear pressure chamber 39 is drained. This takes place just before the hammer piston strikes the adapter 22. The slide 46 is positively retained in its right-hand position because the pressure in the supply conduit 56 is conveyed to the holding surface 65 of the slide. The control passage 62 is already in communication with the drain passage 74 when the piston surface 20 of the piston portion 18 passes the branch passage 61*a* of the control passage 61 so that the pressure in the forward pressure chamber 43 is transmitted through the control passage 61 to the end face 59 of the slide. The slide 46 shifts therefore to its left-hand position shown in FIG. 3 where it remains as previously described because of the fluid pressure upon the holding surface 63. Pressurized hydraulic fluid is now supplied through the inlet 47 to the rear pressure chamber 39 and the hammer piston 17 retards due to the hydraulic fluid pressure upon the piston surface 21. Now, the accumulator 48 receives the hydraulic fluid forced out from the pressure chamber 39 because of the movement to the rear of the hammer piston 17 which decreases the volume in the pressure chamber 39. The accumulator 48 is supplied with pressurized hydraulic fluid also during the first part of the work stroke. However, when the hammer piston 17 reached the speed that corresponds to this supplied flow, the accumulator 48 starts supplying pressurized hydraulic fluid to the pressure chamber 39 and thus further increases the speed of the hammer piston 17.

When a feeding force is applied to the rock drilling machine 10, the adapter 22 will be biased against the rotation chuck bushing 33. The rotation chuck bushing 33 will be retained in its position shown in FIG. 1 because the forward-acting force on the retard piston 68 exceeds the feeding force. Therefore, when the feeding force is applied, the contact surface 72 will only be unloaded.

When the drill string and the adapter 22 recoils from the rock during operation of the rock drilling machine, the adapter 22 strikes against the rotation chuck bushing 33. The recoil pulses are transmitted to the retard piston 68 and further to the pressurized hydraulic fluid entrapped in the retard chamber 70, whereby the entrapped fluid cushion works as a recoil pulse transmission member. The accumulator 48 or other suitable spring means is constantly connected to the fluid cushion by means of the hydraulic fluid column in the passage 71. If the recoil force exceeds a certain value, the rotation chuck bushing 33 and therefore also the retard piston 68 are lifted out of contact with the rotation chuck 23. By this arrangement the influence of the recoil on the rock drilling machine 10 is damped. When such instantaneous lifting occurs, the accumulator 48 equalizes the pressure peaks which arise in the fluid cushion. The adapter 22 and the drill string are then returned by means of the pressure in the retard chamber 70 to the position which is independent of the feeding force.

The rotation of the rotation chuck 23 and the adapter 22 is transmitted to the retard piston 68 by means of the rotation chuck bushing 33. The cushion of pressurized hydraulic fluid entrapped in the retard chamber 70 thus provides a thrust bearing for the adapter 22 and the drill string.

The pressure shocks which arise in the retard chamber 70 when the retard piston is caused to lift out of contact with the rotation chuck 23 are equalized by means of the accumulator 48. In order to compensate the leakage which occurs, the retard chamber 70 is connected to a pressurized hydraulic fluid source. In the preferred embodiment, the accumulator connected to the inlet 47 also works as an accumulator for the retard chamber 70. The leakage is then compensated by pressurized hydraulic fluid from the supply conduit 47. Such an embodiment means that one accumulator is saved.

What we claim is:

1. A recoil damping device for a percussion tool which includes a work tool (22), a machine housing (10) coupled to said work tool and adapted to apply a feeding force forwardly to said work tool in a working direction, a hammer piston (17) reciprocating in the machine housing and adapted to deliver impact energy to said work tool, said work tool recoiling after application of impacts thereto, said recoil damping device damping the recoil of said work tool and comprising:

a retard chamber (70) in said machine housing, said machine housing having a surface (73) defining the rearward portion of said retard chamber, a pressurized hydraulic fluid in said retard chamber, a retard piston (68) connected to said work tool said retard piston (68) being normally during operation a predetermined forward position which is remote from said surface (73) of said retard chamber (70), said retard piston (68) having a piston surface (69) which confines axially the retard chamber (70) towards the work tool, and means for maintaining hydraulic pressure in said retard chamber during operation to maintain said retard piston (68) and said work tool out of axial contact rearwardly with said surface (73) and said machine housing.

2. A device according to claim 1, wherein the recoil damping device further comprises an accumulator (48) connected to said retard chamber (70).

3. A device according to claim 1 wherein said retard piston (68) is located rearwardly of said work tool.

4. A device according to claim 1, wherein the percussion tool is a rock drilling machine which includes means (23, 28) for rotating said work tool and wherein the pressurized hydraulic fluid cushion entrapped in said retard chamber provides a thrust bearing for said work tool during the rotation thereof.

5. A device according to claim 4, wherein said means for rotating the work tool comprises a rotation chuck (23).

6. A device according to claim 5, wherein said rotation chuck is journalled rotatably in the machine housing (10) by means of roller bearings (24, 25), one of said bearings being arranged to rest against a forward surface (72) in the machine housing (10).

7. A device according to claim 6, wherein said piston surface (69) of the retard piston (68) and said rear surface (73) in the machine housing confine axially said retard chamber, said rear surface facing forward surface.

8. A device according to claim 7, wherein said means for rotating the work tool further comprises a rotation chuck bushing (33), said rotation chuck bushing having a portion (34) extending between and resting against the retard piston (68) and the rotation chuck (23).

9. A device according to any of the preceding claims, wherein the fluid pressure in the retard chamber is of such magnitude that the force acting on the retard piston (68) in the working direction exceeds the feeding force.

10. A device according to claim 9, wherein said work tool is coupled to said machine housing so as to act on said retard piston between said forward and rear surfaces.

11. A percussion tool comprising:

a work tool, a machine housing (10) coupled to said work tool and adapted to apply a feeding force forwardly to said work tool in a working direction, a hammer piston (17) reciprocating in the machine housing and adapted to deliver impact energy to said work tool, said work tool recoiling after application of impacts thereto, and a recoil damping device damping the recoil of said work tool and comprising:

a cushioning chamber (70) in said machine housing, said machine housing having a surface (73) defining the rearward portion of said cushioning chamber (70), a recoil pulse transmission member, said recoil pulse transmission member comprising a pressurized hydraulic fluid entrapped in said cushioning chamber, a retard piston (68) connected to said work tool, said retard piston being normally during operation in a predetermined forward position which is remote from said machine housing surface (73), said retard piston transmitting the recoils of the work tool to said recoil pulse transmission member, means for maintaining the pressure of said hydraulic fluid in said cushioning member at a level to prevent axial contact rearwardly of said retard piston with said machine housing surface (73), and spring means (48) constantly connected to said recoil pulse transmission member by means of a hydraulic fluid column, said spring means being adapted to equalize pressure shocks which arise in the recoil pulse transmission member when the recoils cause said retard piston to instantaneously move rearwards.

12. A device according to claim 11, wherein said retard piston has a piston surface (69) which confines axially the cushioning chamber towards the work tool, said spring means and said piston surface being dimensioned so that the force acting on the retard piston in the working direction exceeds the feeding force.

13. A device according to claim 2, comprising a conduit (47) coupled to said accumulator (48), and means in said machine housing defining a variable volume pressure chamber (39) for urging said hammer piston (17) forward, said conduit (47) interconnecting a source of hydraulic fluid and said variable volume pressure chamber (39).

14. A percussion tool according to claim 11 wherein said retard piston (68) is located rearwardly of said work tool.

* * * * *